US005137419A

United States Patent [19]

Waterman

[11] Patent Number: 5,137,419

[45] Date of Patent: Aug. 11, 1992

[54] AXIAL FLOW COMPRESSOR SURGE MARGIN IMPROVEMENT

[75] Inventor: Michael J. C. Waterman, Watford, England

[73] Assignee: Rolls-Royce plc, Bristol, England

[21] Appl. No.: 788,547

[22] Filed: Jun. 6, 1985

[30] Foreign Application Priority Data

Jun. 19, 1984 [GB] United Kingdom ..... 8415605

[51] Int. Cl.[5] ..... F04D 29/54

[52] U.S. Cl. ..... 41/170.1; 415/914; 60/269

[58] Field of Search ..... 415/119, 219 R, DIG. 1, 415/144, 172 A, 168, 181, 77, 914, 170.1; 60/269; 137/15.1, 15.2

[56] References Cited

U.S. PATENT DOCUMENTS 3,893,782 7/1975 Pierpoline ..... 415/119
4,086,022 4/1978 Freeman ..... 415/144
4,531,362 7/1985 Barry ..... 415/119
4,534,701 8/1985 Wisser ..... 415/DIG. 1
4,540,335 9/1985 Yamaguchi ..... 415/DIG. 1

FOREIGN PATENT DOCUMENTS 1518293 7/1978 United Kingdom .

*Primary Examiner*—Michael J. Carone
*Attorney, Agent, or Firm*—Oliff & Berridge

[57] ABSTRACT

The casing 24 of an axial flow compressor 12 is provided with a plurality of axially extending circumferentially spaced slots 30 in its internal cylindrical surface 32 adjacent the tips of at least one row of blades 26. A benefit in both surge margin improvement and a reduction in efficiency deficit may be achieved by positioning the leading edge of the slot 30 such that it leads the leading edge of the blade 26 by an amount termed the overhang or by reducing the closed to open ratio of the slots 30. A further reduction in efficiency deficit may be achieved by combining the overhang which individually gave the best surge margin improvement with a slot 30 closed to open ratio somewhat higher than the value which individually gave the best surge margin improvement.

9 Claims, 4 Drawing Sheets

AXIAL FLOW COMPRESSOR SURGE MARGIN IMPROVEMENT

BACKGROUND OF THE INVENTION

This invention relates to gas turbine engines and more particularly to axial flow compressors for such engines.

An axial flow compressor generally comprises one or more rotor assemblies that carry blades of aerofoil section, the rotor assemblies are carried within a casing within which are located stator blades. The compressor is a multi-stage unit, as the amount of work done (pressure increase) by each stage is small; a stage consists of a row of rotating blades followed by a row of stator blades. The reason for the small pressure increase across each stage is that the rate of diffusion and the deflection angle of the blades must be limited if losses due to air breakaway of the blades and subsequent blade stall are to be avoided.

The condition known as stall, or surge, occurs when the smooth flow of air through the compressor is disturbed. Although the two terms "stall" and "surge" are often used synonymously, there is a difference which is mainly a matter of degree. A stall may affect only one stage or even group of stages, but a compressor surge generally refers to a complete flow breakdown through the compressor.

The value of airflow and pressure ratio at which a surge occurs is termed the "surge point". This point is a characteristic of each compressor speed, and a line which joins all the surge points, called the surge line (FIG. 7), defines the maximum stable airflow which can be obtained at any rotational speed. A compressor is designed to have a good safety margin (Region A) between the airflow and the pressure ratio at which it will normally be operated (the working line), and the airflow and pressure ratio at which a surge will occur.

For satisfactory operation of a compressor stage, it is well known that it, and also the adjacent stages of the blades, must be carefully matched as each stage possesses its own individual airflow characteristics. Thus it is extremely difficult to design a compressor to operate satisfactorily over a wide range of operating conditions such as an aircraft engine encounters.

Outside the design conditions, the gas flow around the blade tends to degenerate into a violent turbulence, and the smooth pattern of flow through the stage or stages is destroyed. The gas flow through the compressor usually deteriorates and becomes a rapidly rotating annulus of pressurized gas about the tips of one compressor blade stage or group of stages. If a complete breakdown of flow occurs through all the stages of the compressor such that all the stages of blades becomes "stalled", the compressor will "surge".

The transition from stall to surge can be so rapid as to be unnoticed, or on the other hand, a stall may be so weak as to produce only slight vibration or poor acceleration or deceleration characteristics. A more severe compressor stall is indicated by a rise in turbine gas temperature, and vibration or "coughing" of the compressor. A surge is evident by a bang of varying severity from the engine compressor and a rise in turbine gas temperature.

It is necessary to use a system of airflow control to ensure the efficient operation of an engine over a wide speed range and to maintain the safety margin referred to above. A well known method of control is described in British Patent 1,518,293 and consists of providing the compressor casing of such an engine with a circumferential row of slots inclined to the axis of rotation of the rotor blade row and disposed within its internal cylindrical surface adjacent to at least one blade row. The slots have an axial length substantially greater than that of the blade row, and terminate downstream of the blade row.

SUMMARY OF THE INVENTION

An object of the present invention is to provide a form of compressor casing treatment which optimizes both the geometry and position of the slot relative to the blade, in order to obtain a stall margin improvement without excessive loss of compressor efficiency.

Accordingly the present invention provides an axial flow compressor, comprising a casing having an internal cylindrical surface, in which is mounted a rotor carrying at least one row of generally radially extending blades, each of said blades having a leading edge which describes an arc upon rotation of said rotor and a trailing edge which describes an arc upon rotation of said rotor, one or more slots disposed within the internal cylindrical surface of the casing adjacent the tips of at least one of said blade rows, each of said slots having a leading end and a trailing end, characterized in that the leading ends of the slots extend axially upstream of the arc described by the leading edges of the blades and the trailing ends of the slots lie in the same plane as, or axially upstream of, the arc described by the trailing edges of the blades. Preferably the base surface of each inclined slot is shaped to allow a smooth exit of high pressure fluid from the slot.

Additionally each slot is disposed such that its sidewalls are arranged at an angle to a radial line through the center of the casing and so extend non-radially into the internal cylindrical surface of the casing with respect to the rotor axis, and the angle of inclination of the slot may be substantially equal to the exit angle of the fluid leaving the blades.

Tests have shown that an improvement in surge margin can be obtained by altering the ratio of the distance between the slots to the slot width, measured circumferentially around the compressor casing. This ratio is known as the closed to open ratio or (m/M) as shown in FIG. 4. Improvements may also be made in the surge margin by altering the axial position of the slot such that the leading edge of the slot leads the leading edge of the blade by an amount termed the overhang.

It was expected that the best overall improvement in the compressor characteristics would be obtained by combining the m/M ratio with the overhang which individually provided the best surge margin improvement. Further tests showed, however, that this was not the case and that in fact the best overall improvement in the compressor characteristics was obtained by combining the previous best known overhang with an (m/M) ratio somewhat higher.

BRIEF DESCRIPTION OF THE DRAWINGS

The present invention will now be more particularly described, by way of example only, and with reference to the accompanying drawings, in which.

DESCRIPTION OF THE PREFERRED EMBODIMENTS

Figure 1:
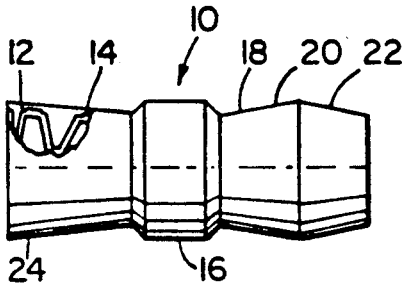
FIG. 1 shows a pictorial side elevation of a gas turbine engine having a broken away compressor casing portion disclosing a diagrammatic embodiment of the present invention.

Referring to FIG. 1 of the drawings, a gas turbine engine shown generally at 10 comprises in flow series a low pressure compressor 12, a high pressure compressor 14, combustion equipment 16, a high pressure turbine 18, a low pressure turbine 20 and exhaust nozzle 22. The low pressure compressor 12 and low pressure turbine 20, and the high pressure compressor 14 and high pressure turbine 18 are each rotatably mounted upon a co-axially arranged shaft assembly not shown in the drawings. A diagrammatic view of an embodiment of the present invention is shown within the broken portion of the low pressure compressor casing 24.

Figure 2:
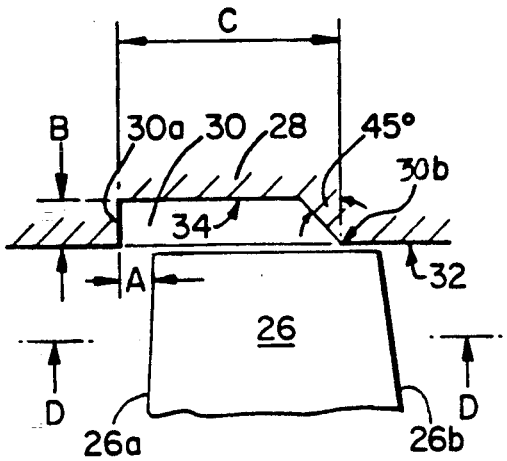
FIG. 2 illustrates in more detail the casing treatment shown in the broken away portion of FIG. 1.

FIG. 2 of the drawings shows a cross-sectional view in greater detail of that shown diagrammatically in FIG. 1 and comprises a portion of low pressure compressor blade 26 having a leading edge 26(*a*) and a trailing edge 26(*b*) on one stage of the low pressure compressor 12. A compressor casing 24 is arranged radially outwardly of the low pressure compressor 12, a portion of which is shown at 28. A circumferentially extending array of inclined slots, one of which is shown at 30, are provided within the internal cylindrical surface 32 of the compressor casing portion 28. Each slot 30 has a depth B and an axial length C and is shaped and positioned such that the leading end 30(*a*) of the slot 30 extends axially upstream of the arc described by the blade leading end 26(*b*).

Figure 3:
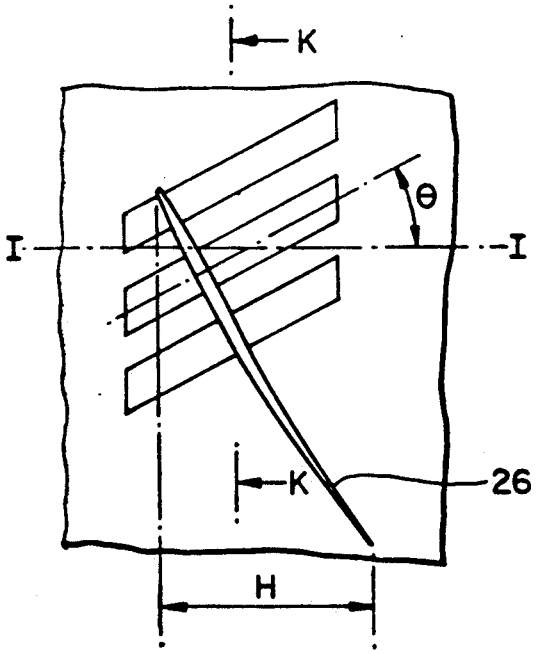
FIG. 3 shows a view in the direction of arrows D—D in FIG. 2.

Referring to FIG. 3, the skew angle $\theta$ of the inclined slot is arranged to be substantially the same as the gas outlet angle of the compressor blade 26. The gas outlet angle to that angle at which the compressor gas leaves the row of compressor blades, and is usually substantially 35°. This angle is obviously also the same angle as that of the gas inlet angle of the adjacent downstream stator blade row (not shown). Dimension H defines the axial length of the blade 26 measured between its leading edge 26(*a*) and its trailing edge 26(*b*) along an axis parallel to the, centerline of the compressor I—I.

As will be seen from FIG. 2 of the drawings, the base 34 of each slot 30 is substantially flat except for the trailing end 30(*b*) which is tapered at an angle arranged to be approximately 45° to the compressor longitudinal axis. It will be appreciated however that alternative surfaces may be incorporated, for example, the slots 30 may be formed with a concaved bottom surface or with a taper at both ends in order to effect a smoother passage of air through the slots 30. The longitudinal sidewalls 36 of each slot 30 are inclined to the radial plane as shown in FIG. 4.

Figure 4:
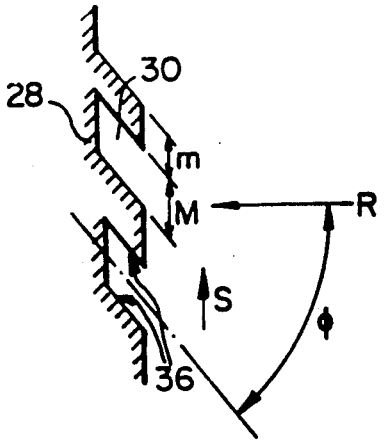
FIG. 4 is a cross-sectional view of the slots in the direction of arrows K—K in FIG. 3.

FIG. 4 of the drawings shows a cross-sectional view taken in the direction of arrows KK of FIG. 3. The slots 30 extend non-radially into the compressor casing 28 at an angle $\phi$ relative to a radial axis R of the compressor 12. This angle $\phi$ being so arranged that the slots 30 collect presurized gas from the compressor blade 26. The direction of travel of the compressor blade 26 is indicated by arrow S. The slot closed to open ratio is illustrated by dimensions m and M respectively.

It has been found that the slots 30 provided within the low pressure casing 28 can provide a degree of control or in fact eliminate a "stall" and thus substantially reduce the likelihood of "surge" occurring.

The following results are given as examples of the benefits obtainable for a set of blades as tested.

The slot axial length C was arranged to be equal to the axial length H of the blade 26 measured at its radially outermost portion approximately 12 mm (0.47 inches). The optimum overhang A of the slot 30 was found to be equal to approximately 23% of the blade 26 axial length H measured at its radially outermost portion. It is reasonable to expect similar benefits will be achieved on blades of other dimensions in which the overhang A of the slot 30 is similarly arranged to be approximately equal to 23% of the blades axial length.

Figure 5:
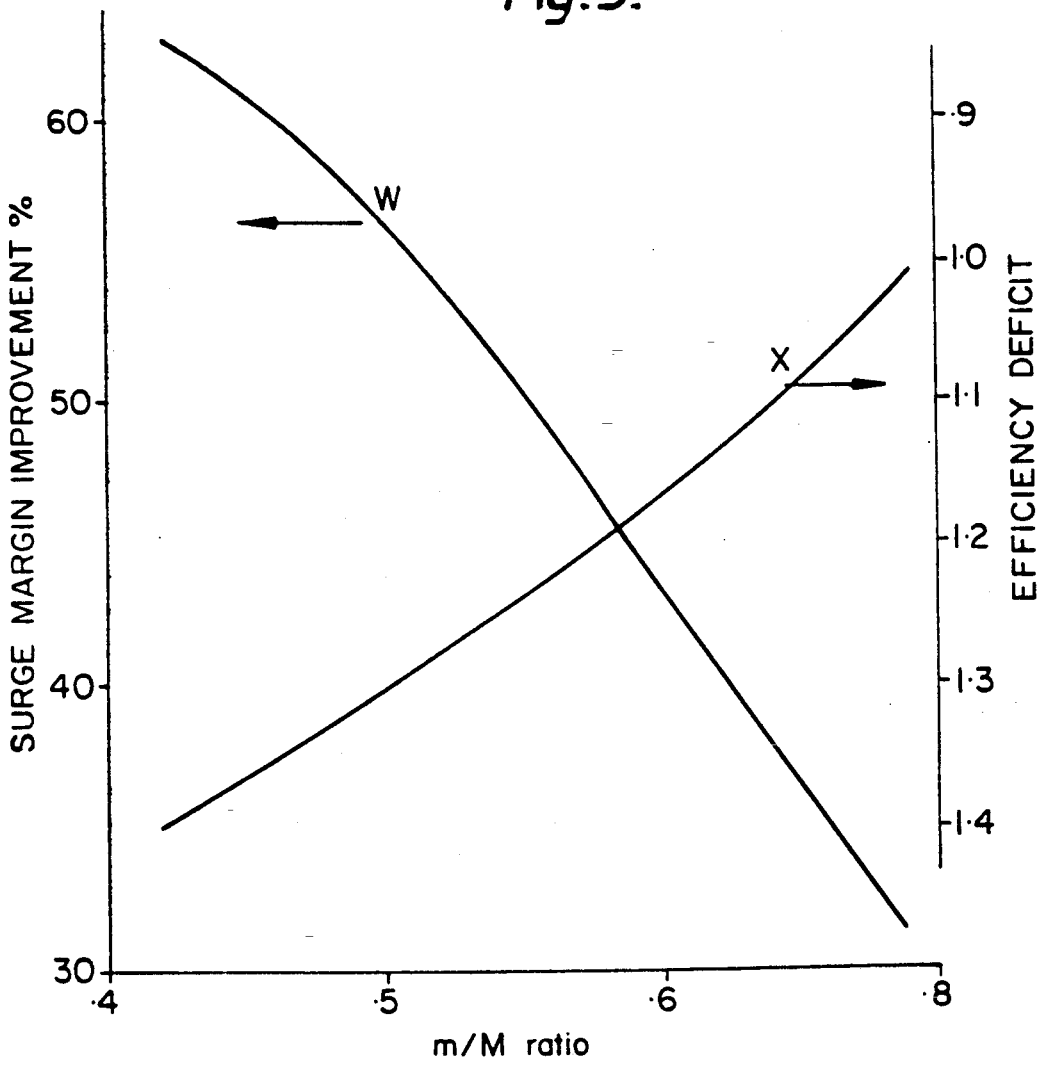
FIG. 5 is a graph of surge margin improvement (line W) and efficiency deficit (line X) plotted against the closed to open ratio (m/M) for a zero overhang casing treatment.
Figure 7:
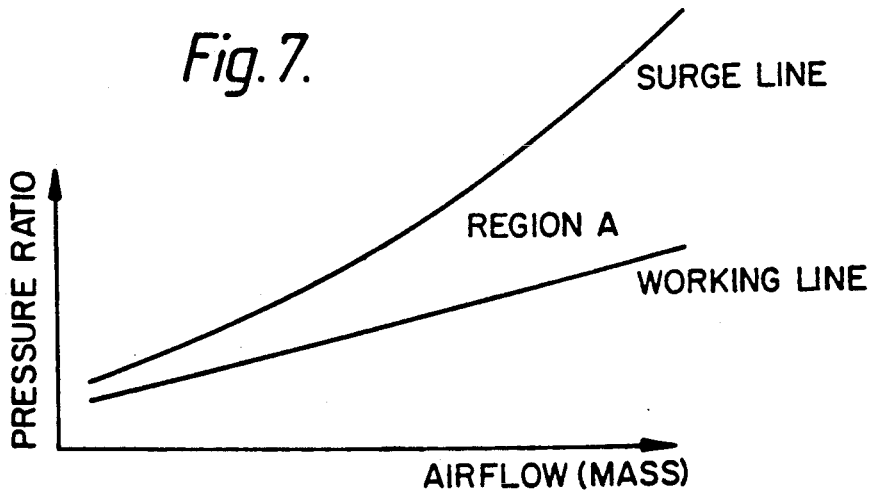
FIG. 7 is a graph of pressure ratio against mass flow for a typical compressor, clearly illustrating the surge line, the working line and the safety margin between the two (region A).
Figure 8:
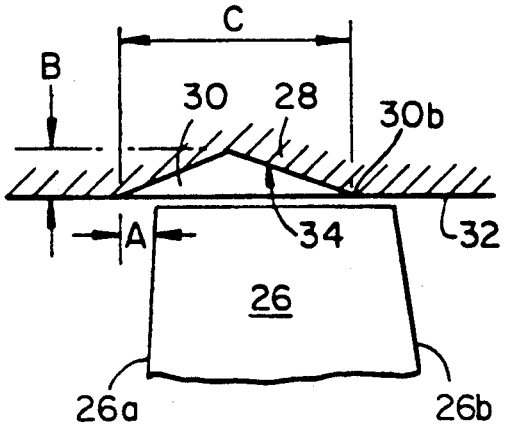
FIGS. 8, 9 and 10 illustrate three alternative slot shapes.
Figure 9:
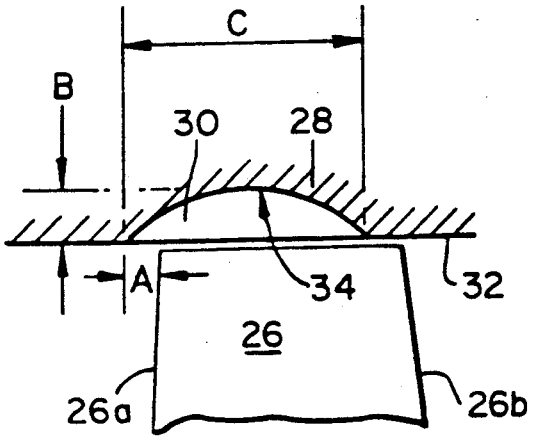
Figure 10:
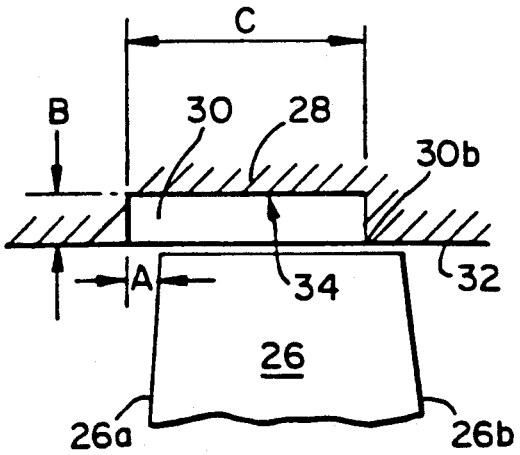

In a first test, with a casing treatment having zero overhang, there was found to be a definite advantage in improved surge margin by reducing the closed to open ratio (m/M) to as low a value as 0.42. This is clearly illustrated in FIG. 5 (line W). However, as indicated in this Figure (line X) the efficiency deficit increases with reduction in the closed to open ratio. At the best recorded closed to open ratio of 0.42, giving the maximum surge margin improvement of 63%, the deficits in flow (not shown) and efficiency were in the region of 1.1% and 1.4% respectively.

A second test showed that for a casing treatment having a given m/M ratio a further benefit in surge margin improvement was obtainable by altering the slot overhang such that the leading edge of the slot leads the leading edge of the blade. The greatest benefit was obtained with an overhang of between 2.54 mm and 4.6 mm (0.1" and 0.18"), having a surge margin impro improvement of 64%.

It was reasonably expected that the best overall improvement in surge margin would be achieved by combining the previously best overhang from Test 2 with the best open to closed ratio from Test 1

A third test, however, showed that this was not the case and that the same maximum improvement in surge margin was obtained by combining the previous best overhang with a closed to open ratio somewhat higher than Test 1, and that this combination gave a reduced deficit in flow and efficiency.

The advantage of the overhang is that it gives the same (i.e. maximum) surge margin improvement at higher m/M value with a corresponding reduction of the flow and efficiency deficits.

Figure 6:
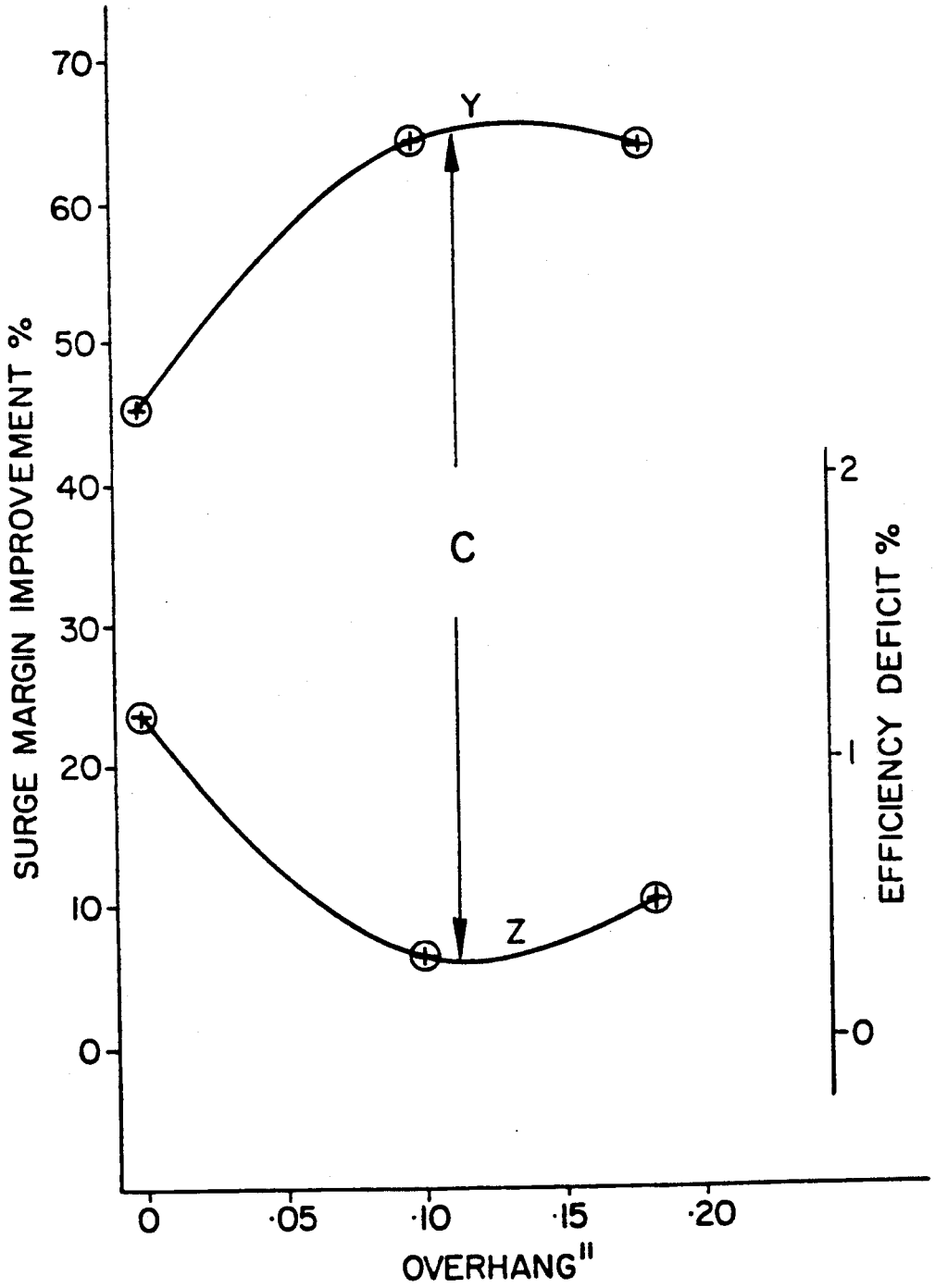
FIG. 6 is a graph of surge margin improvement (line Y) and efficiency deficit (line Z) plotted against overhang for a slotted casing treatment having a closed to open ratio of 0.58.

The optimum combination was found to be one having an m/M ratio of 0.58 and an overhang of approximately 2.8 mm (0.11 inches). FIG. 6 is a graph of surge margin improvement (line Y) and efficiency deficit (line Z) plotted against overhang for a slotted casing treatment having a closed to open ratio of 0.58. The rise in surge margin improvement is clearly illustrated by line Y; there being a rapid rise in improvement between zero and 2.5 mm (0.10 inches) overhang whilst the maximum improvement is achieved between 2.8 mm (0.11 inches) and 4.6 mm (0.18 inches) overhang. The corresponding reduction in efficiency deficit is clearly illustrated by line Z which has a rapid reduction in deficit between zero overhang and 2.5 mm (0.1 inches) overhang, the minimum value being reached with an overhang between 2.54 mm (0.1 inches) and 4.6 mm (0.18 inches). Region C marked on the graph indicates the optimum performance conditions. That is to say for a slot having a closed to open ratio of 0.58 and an overhang of approximately 2.8 mm (0.11 inches) a surge margin improvement of 64% can be obtained with an efficiency deficit of just 0.3% and a reduction in flow (not shown) of just 1%.

Whilst there is no actual increase in surge margin improvement between the second and third tests (both 64%) the third test has the advantage of substantial reductions in both the efficiency deficit and flow reduction over the second.

I claim:

1. An axial flow compressor, comprising:

a casing, having an internal cylindrical surface;

a rotor;

at least one row of generally radially extending blades, each of which are mounted on the rotor and have a leading edge and a trailing edge, the leading edges of said blades describing a first arc upon rotation of said rotor, and the trailing edges of said blades describing a second arc upon rotation of said rotor; and at least one slot disposed within the internal cylindrical surface of the casing adjacent the tips of at least one of said blade rows and having a leading end and a trailing end;

wherein the leading end of each slot extends axially upstream of the first arc described by the leading edges of the blades, and the trailing end of each slot lies in the same plane as or axially upstream of the second arc described by the trailing edges of the blades.

2. An axial flow compressor according to claim 1 in which a pair of sidewalls are provided in each slot, said sidewalls being arranged at an angle to a radial line through the center of the casing and extending non-radially into the internal cylindrical surface of the casing.

3. An axial flow compressor as claimed in claim 1 in which each slot is inclined at an angle relative to the longitudinal axis of the compressor such that the angle of inclination is substantially equal to the angle of the fluid leaving the blades.

4. An axial flow compressor as claimed in claim 1 in which the amount by which the leading end of each slot extends axially upstream of the first arc described by the leading edges of the blades is substantially equal to 20% of the blades' axial length.

5. An axial flow compressor as claimed in claim 4 which includes a plurality of slots and in which the ratio of the distance between the slots to the slot width (m/M) is substantially 0.58.

6. An axial flow compressor as claimed in claim 1, including means for enabling a smooth exit of high pressure fluid from each slot.

7. An axial flow compressor as claimed in claim 6, in which the means for enabling a smooth exit of high pressure fluid from each slot comprises a base surface which reduces in depth towards the trailing end.

8. An axial flow compressor as claimed in claim 6 in which the means for enabling a smooth exit of high pressure fluid from each slot comprises a base surface which reduces in depth towards both the leading end and the trailing end.

9. An axial flow compressor according to claim 1 in which each slot has a base surface which is at a constant depth.

* * * * *